US008662429B2

(12) United States Patent
Matlin et al.

(10) Patent No.: US 8,662,429 B2
(45) Date of Patent: Mar. 4, 2014

(54) MODULAR DOCUMENT DESTRUCTION SYSTEM

(75) Inventors: Tai Hoon K. Matlin, Round Lake Beach, IL (US); Mitchell C. Stevens, Teutopolis, IL (US); Shawn Michael Applegate, Wood Dale, IL (US); Daniel Namie, Elburn, IL (US)

(73) Assignee: Fellowes, Inc., Itasca, IL (US)

( * ) Notice: Subject to any disclaimer, the term of this patent is extended or adjusted under 35 U.S.C. 154(b) by 78 days.

(21) Appl. No.: 13/351,877

(22) Filed: Jan. 17, 2012

(65) Prior Publication Data

US 2013/0181078 A1 Jul. 18, 2013

(51) Int. Cl.
*B02C 23/16* (2006.01)
*B02C 15/00* (2006.01)
*B02C 7/00* (2006.01)

(52) U.S. Cl.
USPC ..... 241/69; 241/165.5; 241/277; 241/100

(58) Field of Classification Search
USPC ..... 241/277, 275, 152.1, 165.5, 69, 100, 241/236, 60
See application file for complete search history.

(56) References Cited

U.S. PATENT DOCUMENTS 3,065,919 A * 11/1962 Burkett et al. ..... 241/47
3,620,461 A * 11/1971 Pelleschi et al. ..... 241/100
4,522,096 A * 6/1985 Niven, Jr. ..... 83/408
4,913,360 A * 4/1990 Lane et al. ..... 241/223
5,020,309 A 6/1991 Hopkins
5,071,080 A 12/1991 Herbst et al.
5,310,122 A * 5/1994 McFarlane ..... 241/60
5,358,189 A 10/1994 Vandermolen
5,692,262 A 12/1997 Haupt et al.
6,179,231 B1 * 1/2001 Csendes ..... 241/19
6,186,428 B1 * 2/2001 Robinson et al. ..... 241/65
6,581,859 B2 * 6/2003 Adams et al. ..... 241/72
6,966,513 B2 * 11/2005 Chang ..... 241/236
7,040,559 B2 5/2006 Matlin et al.
7,284,715 B2 * 10/2007 Dziesinski et al. ..... 241/36
7,631,823 B2 12/2009 Matlin et al.
7,798,435 B2 9/2010 Matlin
7,823,815 B2 11/2010 Jensen
7,828,235 B2 11/2010 Matlin et al.

(Continued)

OTHER PUBLICATIONS

"Multipurpose high volume Industrial shredder," Kobra Cyclone, manufactured by: Elcoman S.R.L.; no publication date; printed Sep. 10, 2013 from http://www.kobra-shredder.com/images/products/files/kobra/kobra-cyclone.pdf.

(Continued)

*Primary Examiner* — Faye Francis
(74) *Attorney, Agent, or Firm* — Pillsbury Winthrop Shaw Pittman LLP

(57) ABSTRACT

A shredder for shredding articles, the shredder includes a first cutter that provides a first stage of shredding to shred the articles and a second cutter arrangement that provides a second stage of shredding to shred the articles received from the first cutter arrangement. The second cutter arrangement includes a rotary cutter element rotatable to shred the articles into shredded particles and a filter having openings to enable the shredded particles below a predetermined size to pass therethrough. The shredder also includes an outlet allows shredded particles to exit therefrom and a vacuum that provides air flow through the second cutter arrangement for entraining and moving the articles and/or particles through the outlet.

30 Claims, 8 Drawing Sheets

(56) References Cited

U.S. PATENT DOCUMENTS

| | | | | |
|---|---|---|---|---|
| 8,201,766 | B2 * | 6/2012 | Chen | 241/225 |
| 8,267,337 | B2 * | 9/2012 | Webb | 241/27 |
| 2006/0249607 | A1 * | 11/2006 | Castronovo | 241/30 |
| 2010/0140384 | A1 * | 6/2010 | Webb | 241/79 |

OTHER PUBLICATIONS

Picture captured from Kobra Cyclone Demo Video, uploaded to YouTube on Sep. 23, 2011, http://www.youtube.com/watch?v=ukLUbkRxwMI#t=29.

* cited by examiner

MODULAR DOCUMENT DESTRUCTION SYSTEM

BACKGROUND OF THE INVENTION

1. Field of Invention

The present invention is generally related to an apparatus having cutter elements for destroying documents such as paper sheets. In particular, the apparatus includes a cutting mechanism having a rotary blade.

2. Background

A common type of shredder has a shredder mechanism contained within a housing that is mounted atop a container. The shredder mechanism typically includes a series of cutter elements that shred articles such as paper that are fed therein and discharge the shredded articles downwardly into the container. An example of such a shredder may be found, for example, in U.S. Pat. Nos. 7,040,559 and 7,798,435.

A shredder typically has two cutter elements disposed in an interleaving relationship with each other. The cutter elements, along with reduction gears and strippers, are arranged to cut or tear paper. Although using these components to shred paper may be effective, these components may be costly and may require constant maintenance and replacement of parts. For example, the moving components, such as the gears and the cutter elements, may be prone to stress, wear, and failure due to frequent use.

The present invention endeavors to provide various improvements over known shredders.

SUMMARY OF THE INVENTION

One aspect of the invention a shredder for shredding articles, the shredder including a first cutter arrangement constructed and arranged provide a first stage of shredding to shred the articles and a second cutter arrangement constructed and arranged to provide a second stage of shredding to shred the articles received from the first cutter arrangement. The second cutter arrangement includes a rotary cutter element constructed and arranged to be rotatable to shred the articles into shredded particles and a filter having openings to enable the shredded particles below a predetermined size to pass therethrough. The shredder also includes an outlet constructed and arranged to allow shredded particles to exit therefrom and a vacuum constructed and arranged to provide air flow through the second cutter arrangement for entraining and moving the articles and/or particles through the outlet.

Another aspect of the invention provides a shredder system including at least one shredder having a primary shredder mechanism constructed and arranged to shred articles fed therein and a secondary shredder mechanism remote from the at least one shredder and constructed and arranged to receive the shredded articles from the at least one shredder. The secondary shredder mechanism includes a first cutter module including a first rotary cutter element constructed and arranged to be rotatable to further shred the shredded articles into smaller particles and a first filter having openings to enable the shredded particles below a predetermined size to pass therethrough. The shredder also includes a vacuum constructed and arranged to provide air flow for entraining and moving the shredded articles and/or particles from the at least one shredder through the secondary shredder mechanism and a waste receptacle having an interior waste receiving space for receiving the shredded particles from the secondary shredder mechanism.

Other objects, features, and advantages of the present invention will become apparent from the following detailed description, the accompanying drawings, and the appended claims.

DETAILED DESCRIPTION OF THE PREFERRED EMBODIMENT(S) OF THE INVENTION

Figure 1:
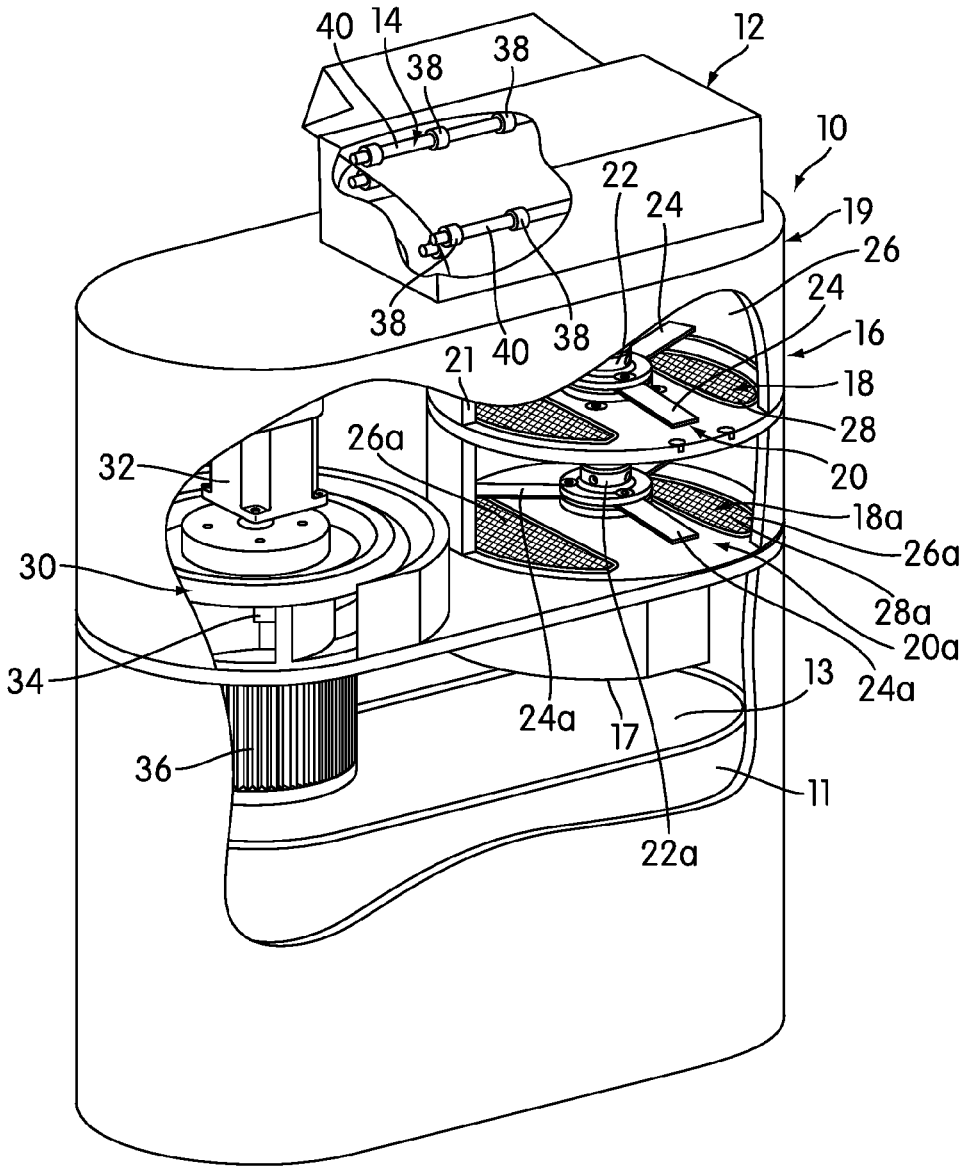
FIG. 1 is a perspective view of a shredder in accordance with an embodiment of the present invention with certain parts removed to better reveal others.

FIG. 1 is a perspective view of a shredder 10 in accordance with an embodiment of the present invention. The shredder 10 is designed to destroy or shred articles such as paper, envelopes, CDs, DVDs, and the like. For explanatory purposes only, throughout this description, the shredder 10*a* is described as holding and feeding papers and/or sheets for shredding. However, it is noted that any type of article may be provided in the shredder 10*a* and thus should not be limited with regard to its description. As used herein, shredded articles and shredded particles or particles are interchangeable and may mean similar things, such as articles that have been shredded. In addition, the term "shredder" or "shredder apparatus," used interchangeably throughout this specification, are not intended to be limited to devices that literally "shred" documents and articles, but instead intended to cover any device that destroys documents and articles in a manner that leaves such documents and articles illegible and/or useless.

As shown in FIG. 1, the shredder 10 includes a first housing 12 that houses a feed mechanism 14 for receiving articles to be shredded. A rotary shredder mechanism 16 is provided in a second housing 19 and is constructed and arranged to receive and shred the articles from the feed mechanism 14 into shredded particles. A waste receptacle 11 is provided within the housing 19 to receive the shredded particles from the rotary shredder mechanism 16. The waste receptacle 11 has an interior waste receiving space 13 for receiving the shredded particles. In some embodiments, the waste receptacle 11 may be removable from the housing 19 to facilitate emptying of the waste receptacle 11. Alternatively, in some embodiments, the waste receptacle 11 may be remote from the rest of the shredder 10. In such embodiments, the waste receptacle 11 may be connected to the shredder mechanism 16 via tubes, ports, or other conduits that enable the shredded particles from the shredder mechanism 16 to be transported to the remote waste receptacle 11. It is contemplated that the waste receptacle may take the form of a container, bin, bag, or any other structures capable of storing shredded particles.

The housings 12, 19 may be integrally formed in some embodiments or may be separate pieces connected together. The first housing 12 may sit atop the second housing 19. Although two housings 12, 19 are shown in this embodiment, it should be appreciated that the number of housings to house the feed mechanism 14, shredder mechanism 16, and waste receptacles 11 may vary. That is, any combination of the feed mechanism 14, shredder mechanism 16, and waste receptacle 11 may share housing(s) or may each have separate housings with openings that enable passage of shredded articles to different parts of the shredder 10.

The shredder mechanism 16 includes an opening or port (obstructed from view in FIG. 1) that receives articles from the feed mechanism 14. The articles received from the feed mechanism 14 may either be unshredded or already shredded articles, which will be described in more detail later. Referring back to FIG. 1, the shredder mechanism 16 includes a first cutter module 18 and a second cutter module 18*a* connected together. The shredder 10 also includes a vacuum 30 that is constructed and arranged to provide air flow through the shredder mechanism 16 for entraining and moving the articles and/or particles through the shredder mechanism 16 to the waste receptacle 11. In other words, vacuum 30 may be used to suction articles or shredded particles through the shredder mechanism 16. The shredded particles may be then be exhausted into the waste receptacle 11 through an exit port 17). A motor 32 may be provided for operating the vacuum 30 to generate a suction force via the air flow.

The waste receptacle 11 may include filters or openings that enable air drawn by the vacuum 30 to pass therethrough. The filters or openings may be sized such that the shredded particles are prevented from passing therethrough. In some embodiments, the waste receptacle may be a bag similar to a vacuum bag. In some embodiments, the bag may include small openings sized to permit air to flow through and prevent the shredded articles from passing through.

As shown in FIG. 1, the first cutter module 18 of the shredder mechanism 16 includes a first rotary cutter element 20 that is rotatably mounted to the first cutter module 18 via a shaft 22. The first cutter element 20 includes a plurality of blades 24, which may be made of steel in some embodiments. The blades 24 may be disposed and rotate within a cutter compartment 26 of the cutter module 18. In some embodiments, the blades 24 may be sized such that tips of the blades 24 are arranged as close to a wall 21 of the cutter compartment 26 as possible during rotation. This arrangement may optimize the number of particles that may be shred by the blades 24 during rotation. In one embodiment, the first cutter module 18 also includes a filter 28 with openings of a selected size to enable shredded particles below a predetermined size to pass therethrough. The second cutter module 18*a* may have a similar configuration as the first cutter module 18. That is, in one embodiment, the second cutter module 18*a* includes a second rotary cutter element 20*a* that is rotatably mounted to the first cutter module 18*a* via a shaft 22*a*. The second cutter element 20*a* also includes a plurality of blades 24*a* that are disposed and rotate within a cutter compartment 26*a* of the cutter module 18*a*. Similar to the blades 24 of the first cutter module 18, the blades 24*a* may be sized such that tips of the blades 24*a* are arranged as close to a wall 21*a* of the cutter compartment 26*a* as possible during rotation. This arrangement may optimize the number of particles that may be shred by the blades 24*a* during rotation. The cutter elements 20, 20*a* may be the rotary type. That is, they may be constructed and arranged to shred articles via a "mulching" action rather than intermeshing with other cutter elements to shred the articles. The second cutter module 18*a* also includes a filter 28*a* with openings of a selected size (which may be smaller than the openings of the filter 28 of the first cutter module 18) to enable particles below a predetermined size to pass therethrough. It is contemplated that additional filters may be added, and the additional filters may have openings having progressively smaller sizes such that particles of progressively smaller sizes are allowed to pass therethrough. The first and second cutter modules 28*a* may be arranged such that the particles shredded by the first cutter element 20 are filtered through the first filter 28 to the second cutter module 18*a* to be further shredded by the second cutter element 20*a*. The particles may then be filtered through the filter 28*a* of the second cutter module 18*a* before passing into the waste receptacle 11. Although the shredder mechanism 16 shown in this embodiment includes two cutter modules 18, 18*a*, it should be appreciated that any number and combination of modules may be provided.

Each of the cutter modules 18, 18*a* may define cutter arrangements that provide stages of shredding. For example, in embodiments having the first and second cutter modules 18, 18*a*, the first cutter module 18 may define a first cutter arrangement that provides a first stage of shredding, and the second cutter module 18*a* may define a second cutter arrangement that provides a second stage of shredding. Additional stages or fewer stages of shredding may be provided by adding or removing cutter modules. In some embodiments, the vacuum 30 may be part of the second cutter module or the second cutter arrangement or may be part of a final or last cutter module or arrangement. That is, in some embodiments, the vacuum 30 may be part of or provide the last stage of shredding.

The cutter elements 20, 20*a* may be constructed and arranged to rotate about a single axis. For example, in the embodiment shown in FIG. 1, the cutter elements 20, 20*a* are constructed and arranged to rotate about the same shaft and accordingly, about a vertical axis. Accordingly, because the cutter elements 20, 20*a* are constructed and arranged to rotate about the same axis, the cutter elements 20, 20*a* do not intermesh. Thus, the cutter elements 20, 20*a* may shred the articles via a "mulching" action.

The components of the shredder mechanism 16, including the cutter modules, may be modular. The components of the cutter modules may also be modular and combinations of the components may be customizable. For example, it should be appreciated that the number of filters for each module may be varied. Thus, although each module in the embodiment of FIG. 1 includes one filter, it should be appreciated that in other embodiments, multiple filters or no filters may be provided for each module. Multiple filters may be combined together in a module to decrease the predetermined size of the particles that may pass through the module. That is, the filters may have openings with progressively smaller sizes such that progressively smaller particles are allowed to pass therethrough to the next module or to the vacuum. Additional modules each having progressively smaller filters may be added.

In some embodiments, in addition to creating suction for the shredded particles, the vacuum 30 may also decrease the amount of dust or small particles from escaping from the shredder 10 and into the air. The vacuum 30 may suction such small particles and dust and a filter 36 may be operatively connected to the vacuum 30 to enable only air to pass therethrough so as to retain the dust and particles within the filter 36.

The cutter elements 20, 20*a* may be rotatable using a motor (not shown). In some embodiments, the controller may send signals to the motor to control the speed of the cutter elements 20, 20*a*. The speed may be user selected or may be preset. However, in some embodiments, the cutter elements 20, 20*a* may be rotated using the same motor 32 used to drive the vacuum 30. For example, the rotation of the cutter elements 20, 20*a* may be linked by belts, axles, or gears, as known in the art, to rotate upon activation of the vacuum 30. In some embodiments, the feed mechanism 14, the cutter elements 20, 20*a*, and the vacuum 30 may be activated based on a power or on/off switch or activation sensors sensing insertion of articles into the shredder 10.

As further shown in FIG. 1, the vacuum 30 includes a centrifugal fan having a rotatable impeller 34 mounted on a central hub (obstructed from view in this Figure). The vacuum 30 may be constructed and arranged to draw in air through the input port of the shredder mechanism 16. The vacuum 30 may generate a negative pressure near the exit port of the shredder mechanism 16, thus drawing the shredded particles through the shredder mechanism 16 and out of the exit port 17. The shredded particles may then fall into the waste receptacle 11 positioned under the exit port of the shredder mechanism 16.

As mentioned above, the articles received by the shredder mechanism 16 from the feed mechanism 14 may or may not already be shredded. Accordingly, the feed mechanism 14 may have various embodiments. For example, the feed mechanism 14 may include feed rollers, a shredder head, or a tray and feed system as described in U.S. Pat. No. 7,828,235, which is incorporated by reference herein in its entirety. The feed mechanism 14 may be configured to enable the articles to exit therefrom smoothly at a predetermined rate. The feed mechanism 14 may also enable ease of use when inserting articles to be shredded. Furthermore, the feed mechanism 14 may prevent the articles from being aggressively pulled into the shredder mechanism 16 and may prevent overloading of the cutting compartments 26, 26*a* in the shredder mechanism 16. In one embodiment, the articles that are fed from the feed mechanism 14 to the shredder mechanism 16 may be sheared during the movement to the shredder mechanism 16. That is, the feed mechanism 14 may hold and feed the articles at a controlled rate to enable the cutter elements 20 of the first module 18 to shear the articles before further shredding the articles.

In one embodiment, the feed mechanism 14 may include a feed opening or throat (not shown) where articles for shredding can be inserted, rotatable feed rollers 38 mounted on an arm 40, and a feed driver system (not shown) configured to rotate arm 40 so as to rotate the feed rollers 38. Each arm 40 may be provided with a plurality of feed rollers 38. A motor may be used to rotate the arm 40, or the arm 40 may be connected to the motor 32 of the vacuum 30 using links, gears, drive axles, and other devices known in the art. Accordingly, one motor could be used to drive many components of the shredder 10. The articles may be received between the feed rollers 38 and advanced towards the shredder mechanism 16 at a predetermined rate. As the articles are fed into the shredder mechanism 16 from the feed mechanism 14 at a predetermined rate, the cutter element 20 of the first cutter module 18 may shear the articles before further shredding the articles in the cutting compartment 26.

Figure 2A:
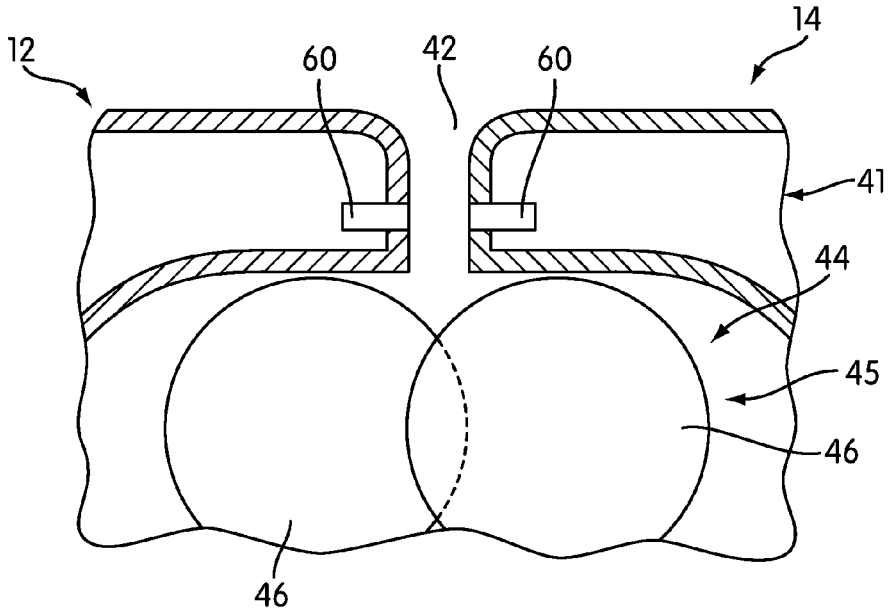
FIG. 2A is a side view of a feed mechanism of the shredder in accordance with an embodiment.
Figure 2B:
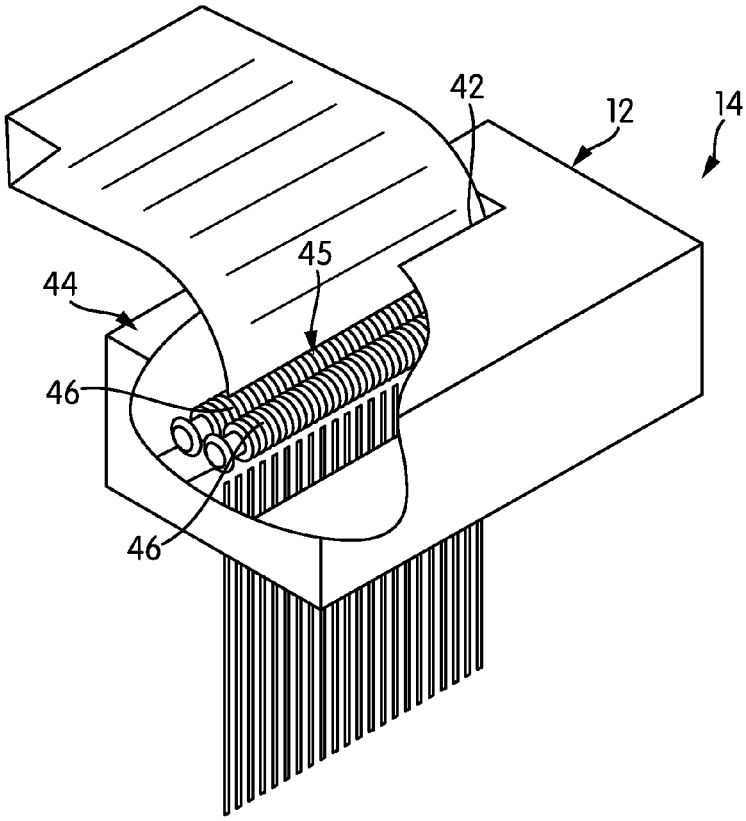
FIG. 2B is a perspective view of an embodiment of the feed mechanism with portions removed to better reveal others.

In one embodiment, for example as shown in FIG. 2A, the feed mechanism 14 may include a shredder head 41 capable of shredding the articles into strips or other shapes. The feed mechanism 14 may include a feed opening or throat 42 where articles for shredding can be inserted and a preliminary shredder mechanism 44 constructed and arranged to shred the articles. The feed mechanism 14 may be part of or may include the shredder mechanism 44, or the feed mechanism 14 may be separate from the shredder mechanism 44. The shredder mechanism 44 may take any form. For example, the shredder mechanism 44 may be a strip cutter shredder mechanism with strip cutting blades. That is, the shredder mechanism 44 may cut the articles via a shearing action. The shredder mechanism 44 may be similar to the shredder mechanisms described in U.S. Pat. Nos. 5,071,080, 7,823,815, and 7,631,823, which are incorporated by reference herein in their entirety. The shredder mechanism 44 may also be any type of conventional shredder mechanisms. When articles are inserted into the throat 14, they are directed toward the shredder mechanism 44 having the cutter arrangement 45 that includes cutter elements 46. These cutter elements 46 may be provided on rotatable shafts and may be arranged to receive articles therebetween. A motor may be used to drive the shafts of the cutter elements 46 so that the cutter elements 46 shred or destroy the articles fed therein. It should be appreciated that the motor used to drive the preliminary shredder mechanism 44 may be the same motor 32 used to operate the rotary shredder mechanism 16. The motor 32 may be connected to a drive system to drive the shredder mechanism 44 via links, gears, drive axles, and other devices known in the art. The shredded articles from the preliminary shredder mechanism 44 may then be fed into the inlet port of the shredder mechanism 16 for further shredding. The configuration and size of the inlet port may vary. In some embodiments, the first module 18 of the shredder mechanism 16 may be open on one side to receive larger sized articles for shredding. FIG. 2B shows an embodiment of the feed mechanism 14 having the strip cutting shredder mechanism 44. The shredder mechanism 44 includes the cutter arrangement 45 that includes two cutter elements 46. The cutter elements 46 are rotatable about axes that are parallel to one another. As shown in FIG. 2B, the articles to be shredded may be inserted between the cutter elements 46 to be shredded into strips.

In embodiments where shredder 10 includes the shredder mechanism 44 (e.g., the strip cut shredder mechanism), the shredder mechanism 44 may include the cutter arrangement 45. In such embodiments, the cutter arrangement 45 may define the first cutter arrangement that provides a first stage of shredding, and the first cutter module 18 of the rotary shredder mechanism 16 may define the second cutter arrangement that provides a second stage of shredding. In embodiments where the second cutter module 18*a* is provided, the second cutter module 18*a* may define the third cutter arrangement that provides a third stage of shredding.

In one embodiment, the feed mechanism 10 may include an "auto feed" mechanism as described in U.S. Pat. No. 7,828,235, which is incorporated by reference herein in its entirety. For example, as shown in FIG. 3, the shredder 10 may include a cartridge or tray 48. Tray 48 comprises a feed bed 50 and is designed to hold articles, taking the form of a plurality or stack of paper sheets 52 in this embodiment, that are to be shredded. The tray 48 is mounted such that the paper may be fed from bed 50 of the tray 48 into the rotary shredder mechanism 16. In an embodiment, the tray 48 is provided with a lid 54. The lid 54 may be pivotable between an open and closed position. Pivoting the lid 54 allows a user access to the inside of tray 48, such as for filling the tray 48 with paper to be shredded.

Figure 3A:
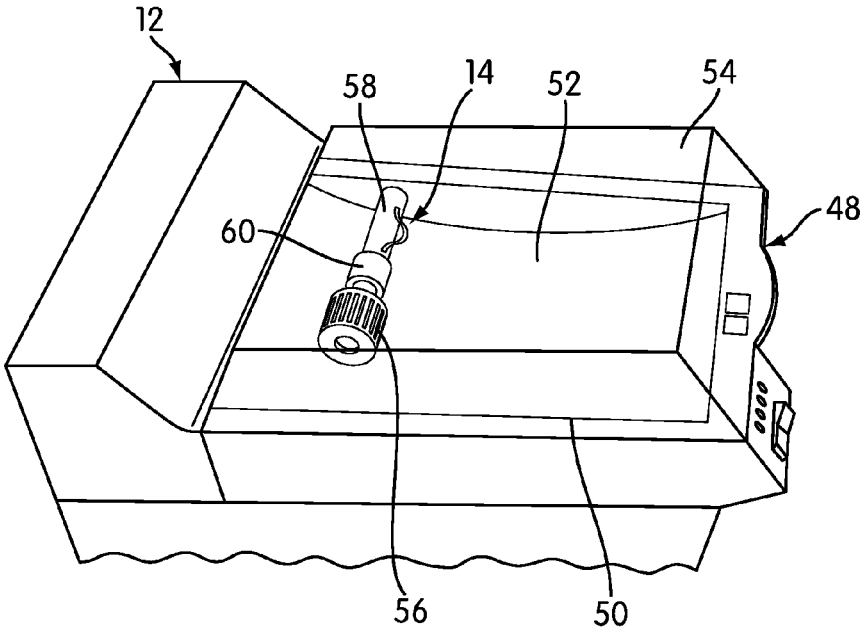
FIG. 3A is an overhead view of a feed mechanism of the shredder in accordance with another embodiment.

In the embodiment shown in FIG. 3A, the feed mechanism 14 includes a rotatable feed roller 56 and an arm 58 designed to work in cooperation with the stack 52 in the tray 48. As shown, the rotatable feed roller 56 of the feed mechanism 14 is positioned above or adjacent the bed 50 of the tray 48. In an embodiment, the rotatable feed roller 56 is mounted on the arm 58. The arm 58 is used to alternatively move the rotatable feed roller 56 between a lowered position for engaging the stack 52 to feed the paper and a raised position for disengaging from the stack 52 to allow the paper to be advanced therethrough. The arm 58 may be an articulating or pivoting arm in some embodiments. The arm 58 may be moved, for example, via a motor and a gear or wheel mechanism(s). The arm 58 may be driven by the motor 32 used to drive the vacuum 30 via links, gears, drive axles, and other devices known in the art, or a separate motor may be provided specifically for activating the arm 58. In one embodiment, a feed driver system 60 comprises a driver for moving the arm between the lowered and raised positions. In an embodiment, a rotary driver is mounted to the arm 58 for rotating the rotatable feed roller 56. The feed roller 56 of the arm 58 is activated and rotated when the lid 54 of tray 48 is closed. The arm 58 may be activated and articulated (e.g., up and down or pivotally) when the lid 54 of the tray 48 is closed or may be activated at other times. When the lid 54 is lifted to access the tray 48, the motor may be deactivated, and thus the arm 58 is prevented from movement (e.g., either pivotally or up and down, or the rotation of the feed roller 56, or both). In an embodiment, a separate motor may be provided for the rotation of the feed roller 56 on arm 58. In some embodiments, the feed mechanism may include an arm that is configured to alternatively move the feed roller between an engaged position for engaging the stack to feed the paper and a disengaged position for disengaging from the stack to allow the paper to be advanced therethrough. That is, the arm and the feed rollers are not necessarily limited to the raised and lowered positions shown in this embodiment, and may be positioned at the sides or at other locations to be alternatively moved to engage and disengage the stacks as to drive and feed the paper into the shredder mechanism.

Figure 3B:
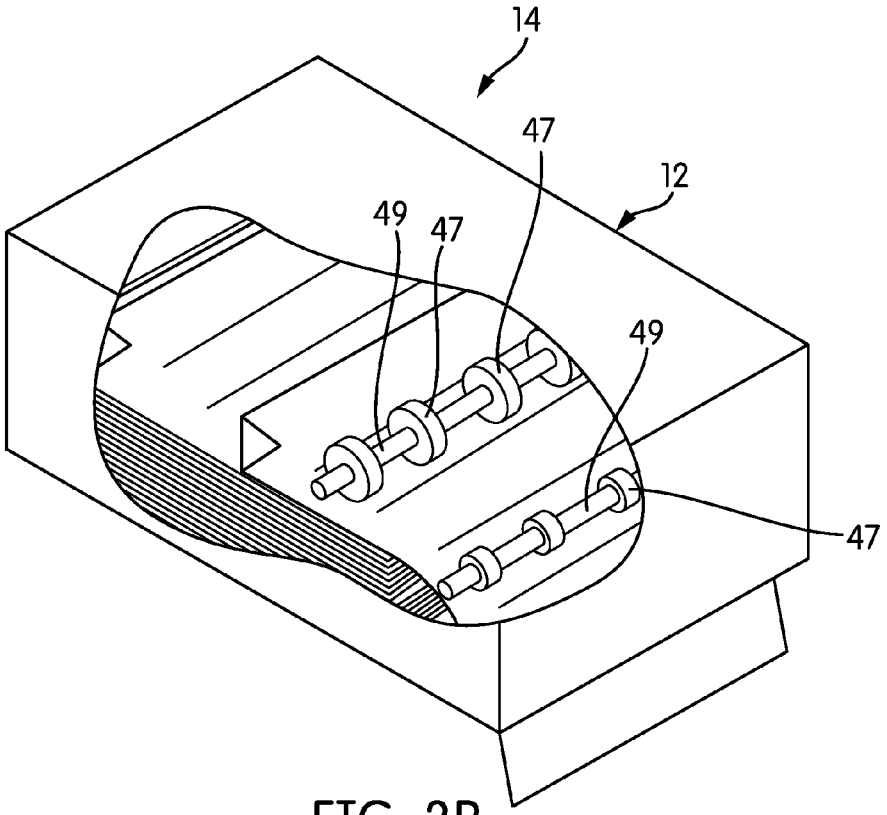
FIG. 3B is a perspective view of another embodiment of the feed mechanism with portions removed to better reveal others.

FIG. 3B shows another embodiment of the feed mechanism 14. In this embodiment, the feed mechanism 14 includes rotatable feed rollers 47 mounted on an arm 49, and a feed driver system (not shown) configured to rotate arm 49 so as to rotate the feed rollers 47. The arm 49 and the rollers 47 may be constructed and arranged to be disposed on top of a stack of papers such that movement of the arm 49 and the rollers 47 facilitate the movement or feeding of the articles towards the shredding mechanism 16. In some embodiments, the sheets of paper may be moved towards the shredding mechanism 16 one by one via the feed mechanism 14. In other embodiments, multiple sheets of paper may be moved towards the shredding mechanism 16 at the same time.

Although several embodiments of the feed mechanism 14 are described above, it should be appreciated that these examples are not intended to be limiting. The feed mechanism 14 may take other forms in other embodiments. It should also be appreciated that in some embodiments, the feed mechanism 14 may be omitted and the articles may directly be fed into the inlet of the shredder mechanism 16.

A power or on/off switch (not shown) may also be provided on the shredder 10. The power switch includes a manually engageable portion connected to a switch module (not shown). Movement of the manually engageable portion of switch moves the switch module between states. The switch module is communicated to a controller (not shown) which may include a circuit board. The term "controller" is used to define a device or microcontroller having a central processing unit (CPU) and input/output devices that are used to monitor parameters from devices that are operatively coupled to the controller. The input/output devices also permit the CPU to communicate and control the devices (e.g., such as a sensor or the motor) that are operatively coupled to the controller. As is generally known in the art, the controller may optionally include any number of storage media such as memory or storage. Typically, a power supply (not shown) is connected to the controller by a standard power cord with a plug on its end that plugs into a standard AC outlet. The controller is likewise communicated to the motor of the shredder mechanism 16. When the switch is moved to an on position, the controller can send an electrical signal to the drive of the motor so that it rotates the cutter elements 20, 20*a* of the shredder mechanism 16 in a shredding direction and can also send an electrical signal to the drive of the motor 32 so that it rotates the impeller 34 of the vacuum 30 to create a suction force. When the switch is moved to an on position, the controller can also send electrical signals to the feed mechanism 14 to operate the feed rollers 38, 47, 56, or the preliminary shredder mechanism 44. The switch may also be moved to an off position, which causes the controller to stop operation of the motor. Generally, the construction and operation of the switch and controller for controlling the motor are well known and any construction for these may be used. Also, the switch need not have distinct positions corresponding to on/off/idle, and these conditions may be states selected in the controller by the operation of the switch.

In one embodiment, an activation sensor 60 (see for example FIG. 2A) may be provided. When the power switch is in its on (or idle) position, the controller may be configured to operate the motor to drive the cutter elements 20, 20*a* of shredder mechanism 16 in the shredding direction when the activation sensor 60 is triggered and detects the presence or insertion of at least one article to be shredded. In some embodiments, as shown in FIG. 2A, activation sensor 60 is provided in the throat 42. The activation sensor 60 may be of a type that emits and detects radiation and is operable to detect the presence or insertion of at least one article based on the interruption of the radiation by the at least one article. The activation sensors may be of the type as described in U.S. Pat. No. 7,823,815, which is incorporated by reference herein in its entirety.

Figure 4:
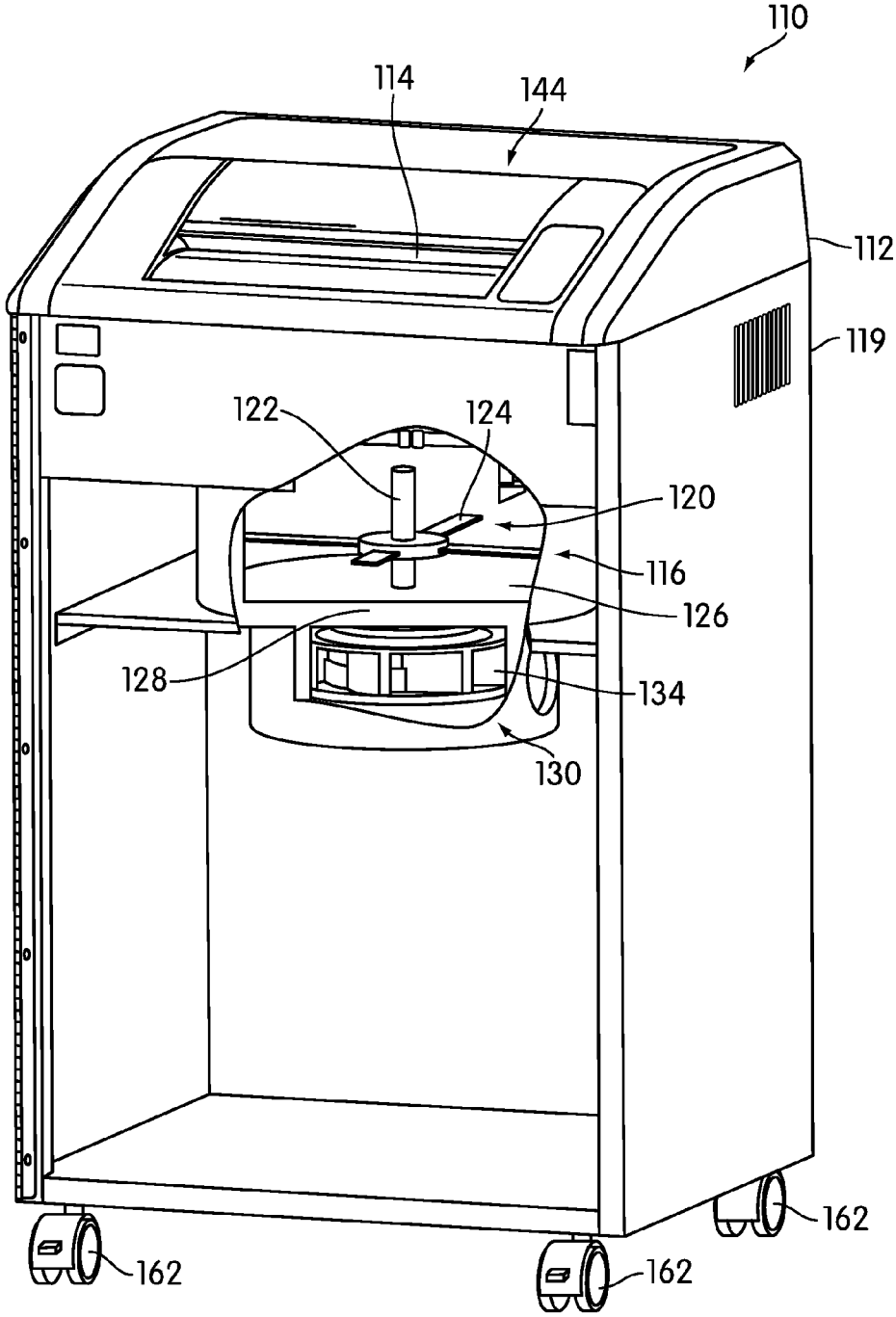
FIG. 4 is perspective view of a shredder in accordance with an embodiment with certain parts removed to better reveal others.

FIG. 4 shows another embodiment of the shredder 110. In this embodiment, the shredder 110 is a conventional shredder retrofitted with a rotary shredder mechanism 116 and vacuum 130. Accordingly, the rotary shredder mechanism is not the only shredder mechanism in such an embodiment. In this embodiment, the conventional shredder and the rotary mechanism 116 and vacuum 130 may be considered to be a single unit. The rotary shredder mechanism 116 may be added or removed from the shredder 110 depending on whether additional shredding is required in addition to the conventional shredder itself. In general, the shredder 110 may have any suitable construction or configuration and the illustrated embodiments provided herein are not intended to be limiting in any way. Optional rollers 162 may be provided to facilitate transport of the shredder 110.

In this embodiment, the shredder 110 includes a preliminary shredder mechanism 144 and a feed mechanism 114 for the rotary shredder mechanism 116. The preliminary shredder mechanism may include the original shredder mechanism that is included with the conventional shredder. The preliminary shredder mechanism may have a similar configuration as the preliminary shredder mechanism 44 described above, or may have any other configurations that enable articles to be shredded. The preliminary shredder mechanism may apply strip-cut, cross-cut, or other types of shredding operations to the articles. The shredded articles may then be fed into the rotary shredder mechanism 116 for further shredding. The feed mechanism 114 may be housed in a housing 112 that sits atop housing 119, which houses the rotary shredder mechanism 116, vacuum 130, and waste receptacle (not shown in this embodiment). The waste receptacle may be removable to facilitate emptying of the waste receptacle.

In this embodiment, the preliminary shredder mechanism 144 may be the first cutter arrangement that provides a first stage of shredding and the rotary shredder mechanism 116 may be the second cutter arrangement that provides a second stage of shredding. The shredder mechanism 116 includes the first cutter module 118, which has a rotary cutter element 120 that includes a plurality of blades 124. The blades 124 are mounted for rotational movement around the shaft 122. The first cutter module 118 also includes a filter 128 that filters the shredded particles from the cutting compartment 126 into the vacuum 130. The filter 128 has openings (not shown) that allows particles below a predetermined size to pass therethrough. The vacuum 130 is provided with impeller 134 that impels air so as to create a suction force to suction the particles through the shredder mechanism 116 into the vacuum 130. The particles are then impelled into the waste receptacle or directly into the housing 119 in embodiments where the waste receptacle is omitted. The shredder mechanism 116 shown in this embodiment may have a different configuration from the shredder mechanism 16 of the shredder 10 described above. For example, as shown in FIG. 4, the shredder mechanism 116 has one cutter module 118 and the shredder mechanism 16 has two cutter modules 18, 18*a*. However, it should be appreciated that the number of modules may vary for shredder mechanisms 16, 116. As mentioned above, any combinations of the cutter modules may be connected together or disconnected to form the shredder mechanisms 16, 116. Furthermore, it should be appreciated that the vacuum 130 may be part of a second cutter module or final cutter module. Accordingly, the vacuum 130 may be part of the second cutter arrangement or final cutter arrangement. In such embodiments, the impeller 134 may be constructed and arranged to shred the articles and thus, the vacuum 130 may provide the last stage of shredding.

Figure 5A:
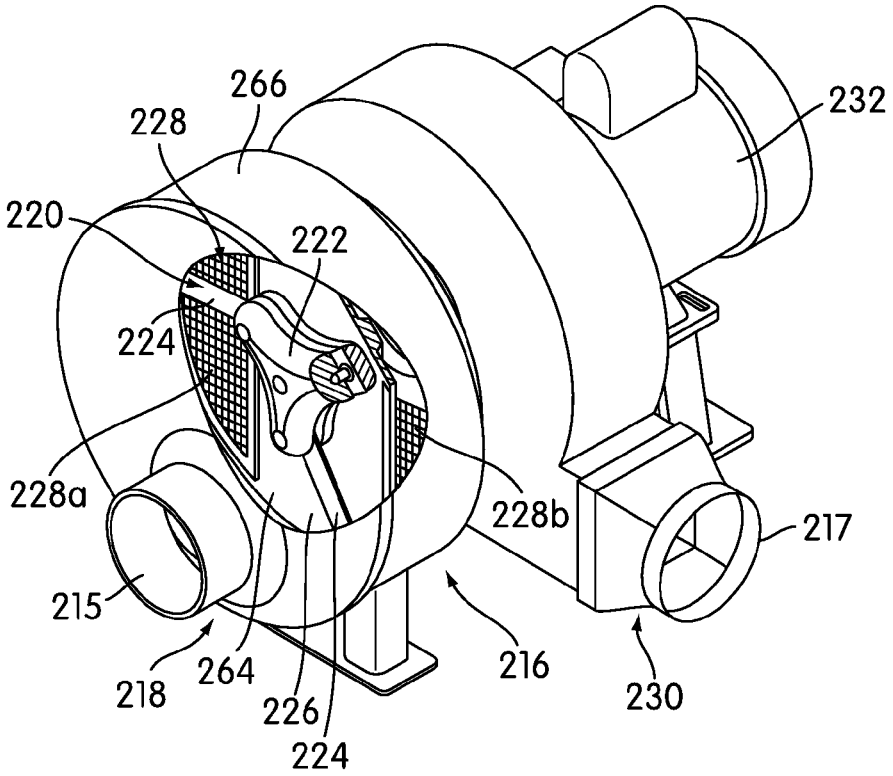
FIG. 5*a* is a perspective view of a rotary shredder mechanism and vacuum in accordance with an embodiment with certain parts removed to better reveal others.

FIG. 5*a* is a detailed view of yet another embodiment of the shredder mechanism 216 having one cutter module 218. The cutter module 218 includes a cutter element 220 disposed in a cutting compartment 226. In this embodiment, a filter 228 is divided into two sections 228*a*, 228*b* with a wall 264 located therebetween. The wall 264 and the two sections 228*a*, 228*b* of the filter 228 separate the cutter module 218 from the vacuum 230. In other embodiments, the filter may be divided into multiple segments. In other embodiments, the wall 264 may be omitted and only a filter 228 may separate the module 218 from the vacuum 230. As mentioned above, any combination and number of filters 228 may be used. Multiple filters 228 may be used together, and the filters 228 may be adjusted to misalign/align the openings so as to vary the resulting opening size of the combined filters. The number of modules and filters can also be adjusted to adjust the size of the resulting shredded particles that are deposited into the waste receptacle. The size of the openings in the filter 228 may also vary. Thus, the particle sizes can be fixed or adjusted.

In some embodiments, at least a portion of a side wall 266 of the cutter module 218 may be provided with openings so as to function as a filter during shredding operation. That is, during operation of the shredder mechanism 216, centrifugal force may expel the particles through the openings formed in the side walls 266 of the cutter module 218. In some embodiments, the vacuum 230 may be omitted and the shredder mechanism 216 may rely on the centrifugal force produced by the rotating cutter elements 220 to expel the shredded particles out of the shredder mechanism 216.

The cutter module 218 may be provided with an inner surface having textures, protrusions, or other structures to slow down or decrease the rate of movement of the shredded particles. The texture may include any type of articulated surface, for example, bumps, or other types of formations. Additional cutter elements 220 and/or additional blades 224 may be provided in other embodiments. Stationary blades or other structures may also be provided in the cutting compartment 226 of the cutter module 218 to facilitate shredding operation.

Figure 5B:
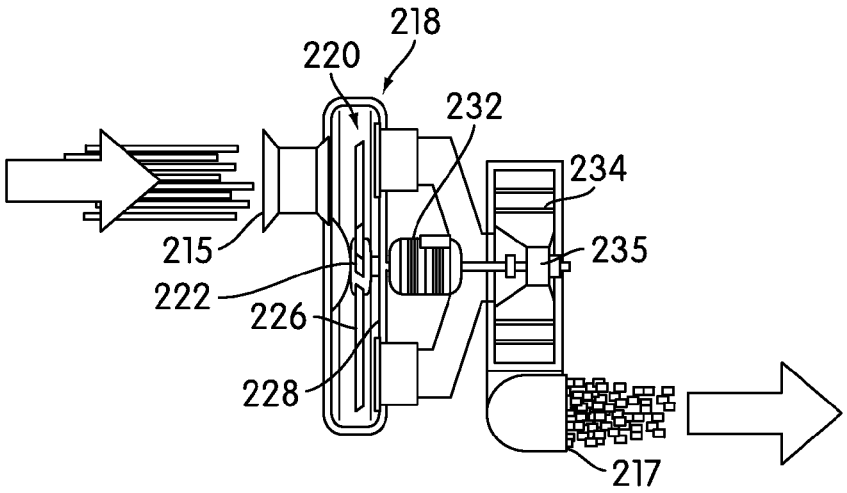
FIG. 5*b* is a side view of the rotary shredder mechanism and vacuum.

FIG. 5*b* shows a cross sectional side view of the shredder mechanism 216 having one module 218. In this embodiment, the vacuum 230 and the shredder mechanism 216 share a motor 232. The motor 232 drives an impeller 234 to rotate around a central hub 235 and drives the cutter element 220 to rotate around a shaft 222. As further shown in this embodiment, the articles for shredding may be fed into the shredder mechanism 216 through an input port 215. The articles may be unshredded articles or may be already shredded articles that are to be further shredded by the shredder mechanism 216. In one embodiment, the articles enter through the input port 215 into the module 218 of the shredder mechanism 216 and is further shredded in the cutting compartment 226 by the rotating blades 224 of the cutter element 220. Particles below a predetermined size are filtered through the filter 228 and into the vacuum 230. The rotating impeller 234 creates a suction force that attracts the particles into the vacuum 230, where the particles 230 may optionally be further shredded by vanes or other structures on the impeller 234. The particles may then be forced out through an exhaust or exit port 217. In this embodiment, only one input port 215 and one exit port 217 are shown. However, it should be appreciated that the combination and number of input ports 215 and exit ports 217 may vary in other embodiments.

Figure 6A:
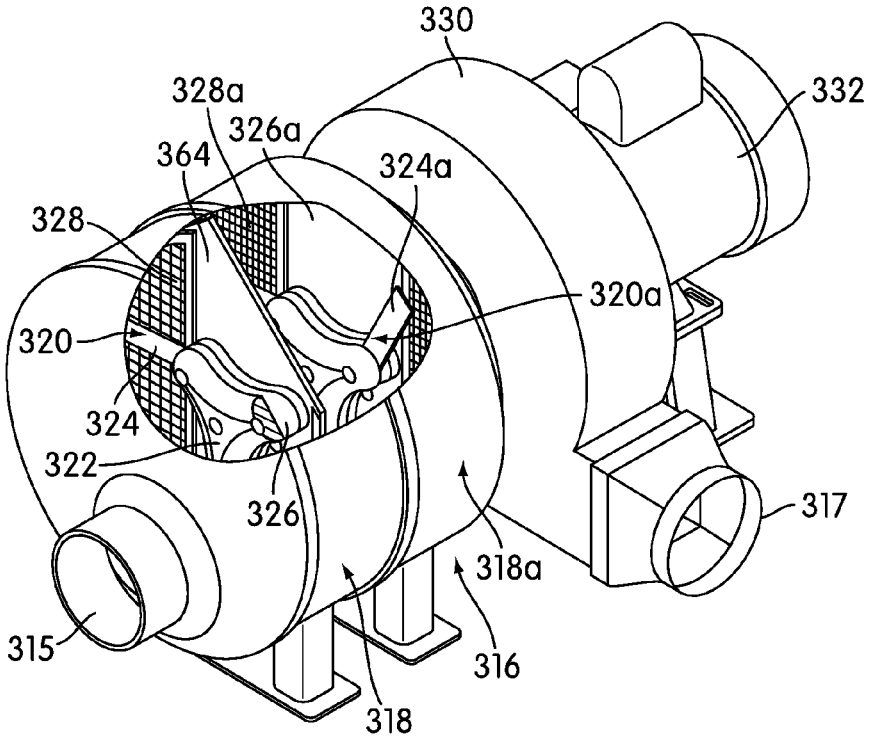
FIG. 6*a* is a perspective view of the rotary shredder mechanism and vacuum in accordance with an embodiment with certain parts removed to better reveal others.

FIG. 6*a* shows in detail an embodiment of the shredder mechanism 316 having two cutter modules 318, 318*a*. First cutter module 318 includes cutter element 320 and second cutter module 318*a* includes cutter element 320*a*. Each of the cutter elements 320, 320*a* may include cutter blades 324. The filter 328 and wall 364 separate the cutting compartments 326 of the first module 318 from the cutting compartment 326*a* of the second module 318*a*. Accordingly, particles that are below a predetermined size may pass through the filter 328 to the cutting compartment 326*a* of the second module 318*a* to be further shredded by the cutter element 320*a* of the second module 318*a*. The filter 328*a* of the second module 18*a* has openings that enable particles of a predetermined size to pass therethrough into the vacuum 330. The filter 328*a* may have smaller openings than the filter 328. Thus, each successive module after the first module 318 may have filters with openings that are smaller than the module before it. As a result, each successive module may shred smaller particles than the module before it. If higher security is needed, additional modules having filters with smaller openings may be added to decrease the size of the particles that exit the port 317.

In some embodiments, the size of the openings of the filter may be considered with respect to the throughput of the of the shredder 310. Throughput may refer to the amount of material that can be shredded in a predetermined amount of time.

Thus, the larger the openings of the filters, the larger the particle sizes and the higher (better) the throughput. Decreasing the size of the openings of the filters (and thus decreasing the size of the particles) may reduce the throughput. In some embodiments, using multiple modules with different size filters to result in particles of a predetermined size may have a better throughput compared to using a single module with a filter that filters particles of the same predetermined size. In other words, in a shredder mechanism 316 having a final cutter module with a filter that enables particles of a certain size to pass therethrough, throughput may be increased by adding modules having larger filters before the final module such that larger particles may be shredded in the earlier stages.

Figure 6B:
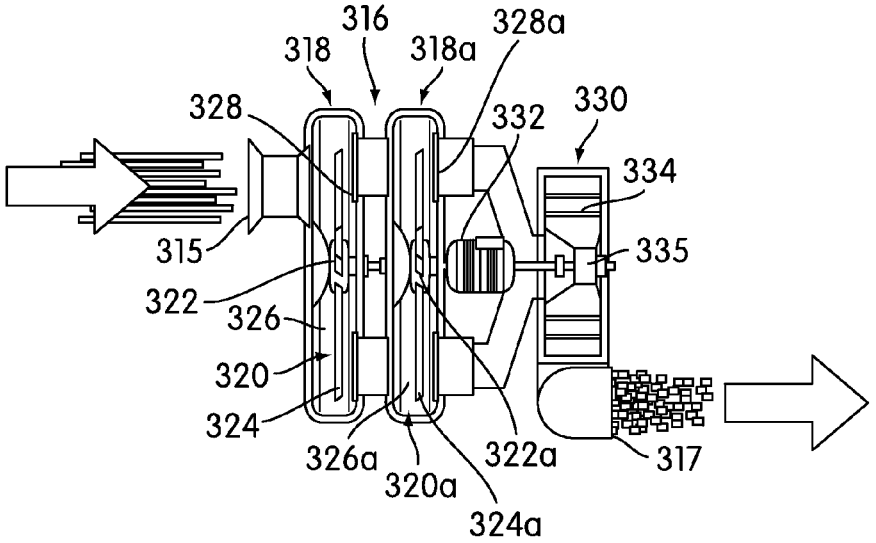
FIG. 6*b* is a side view of the rotary mechanism and vacuum.

FIG. 6*b* shows a cross sectional side view of the embodiment of the shredder mechanism 316 having two cutter modules 318, 318*a*. In this embodiment, the shredder mechanism 316 and the vacuum 330 share a same motor 332. For example, the cutter element 320 of the first module 318 and the cutter element 320*a* of the second module 318*a* are rotated around their shafts 322, 322*a*, respectively, by the motor 332. The motor 332 also rotates an impeller 334 around its central hub 335. As further shown in this embodiment, the articles for shredding may be fed into the shredder mechanism 316 through the input port 315. The articles may be unshredded articles or may be already shredded articles that are to be further shredded by the shredding mechanism 316. The articles are then shredded in the cutting compartment 326 of the first module 318 by the cutter element 320. The filter 328 of the first module 318 has openings that enables particles below a predetermined size to be suctioned through to the second module 318*a* by the suction force created by the impeller 334. The particles are then further shredded in the cutting compartment 326*a* by the cutter element 320*a*. The filter 328*a* of the second module 18*a* has smaller openings than the filter 328 of the first module 318, and thus enables smaller particles to be suctioned through to the vacuum 330. The impeller 334 of the vacuum 330 may further shred the articles before impelling the particles through the exit portal 317.

Figure 6C:
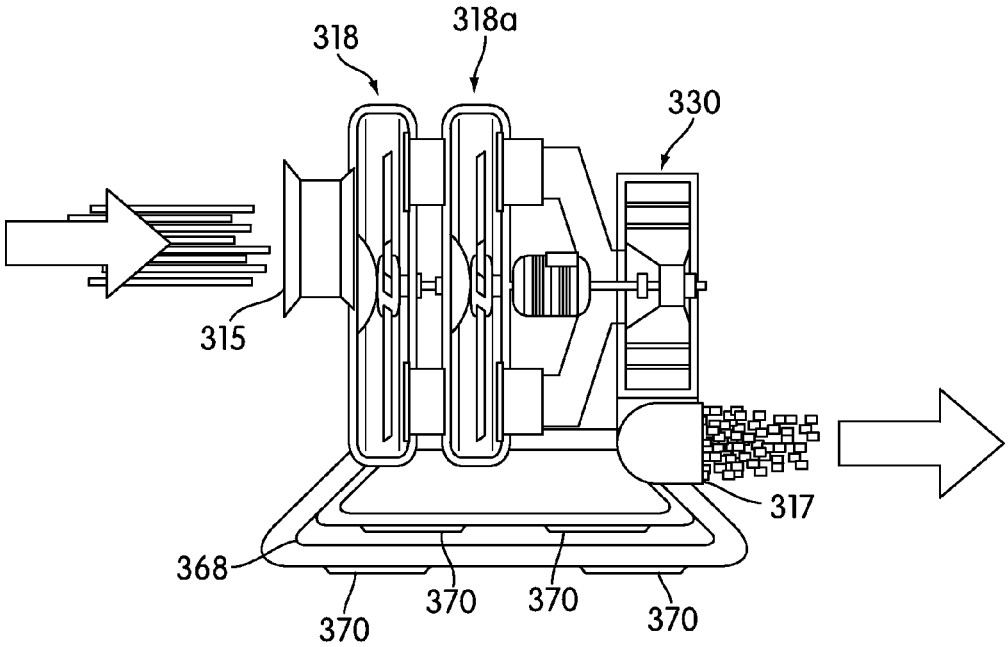
FIG. 6*c* is a side view of the rotary mechanism and vacuum with a stand.

FIG. 6*c* shows a cross sectional side view of the shredder mechanism 316 with the two cutter modules 318, 318*a*. In this embodiment, the shredder mechanism 316 and the vacuum 330 are supported on a stand 368. The stand 368 may be provided with feet 370 that are constructed and arranged to rest on surface. The stand 368 helps support the shredder mechanism 316 and the vacuum 330 while they function as a retrofittable device connected to a feed mechanism or a conventional shredder.

Figure 7:
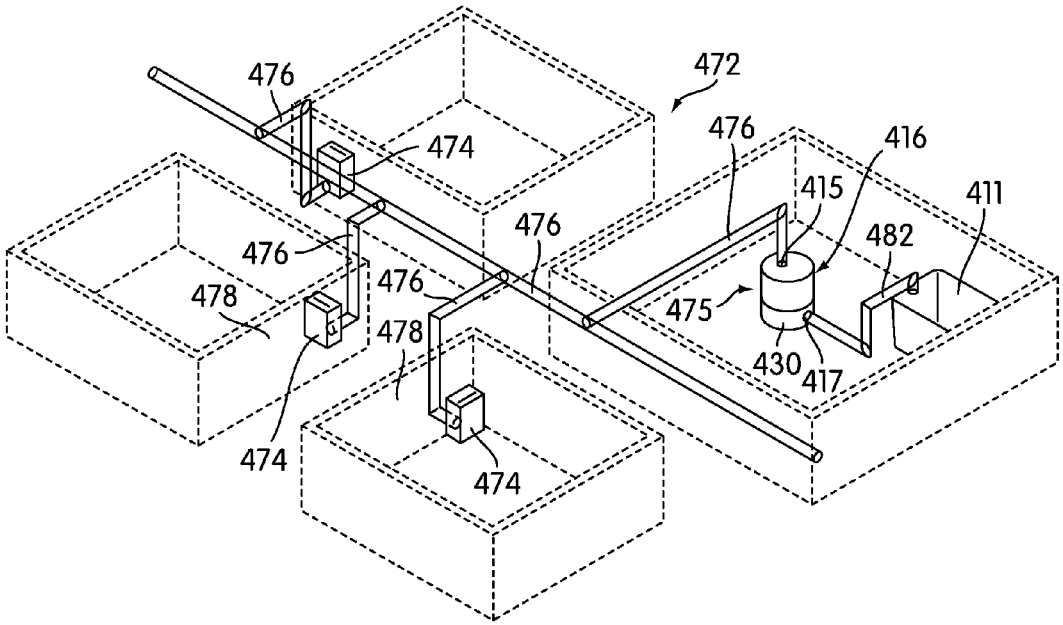
FIG. 7 is an overhead view of a shredder system in accordance with an embodiment.

FIG. 7 shows an embodiment of a shredder system 472 having at least one shredder 474. The shredder 474 may be a conventional strip or cross-cut shredder or any type of shredders that enable shredding of articles. The primary shredder mechanism (not shown in this Figure) in the shredders 474 may be any type of shredder mechanism. Just for example, the primary shredder mechanism may have a similar configuration as the preliminary shredder mechanism 444 described above, or may have any other configurations. In some embodiments, the shredder 474 may include only a feed mechanism without cutter elements and may not include a shredder mechanism. In such embodiments, the shredder 474 does not perform a shredding operation. That is, the shredder 474 may function to enable articles to be fed therein at a controlled or predetermined rate. The at least one shredder 474 may include any combination or types of shredders and do not all have to be the same type or have the same configuration. The shredders 474 may be mounted on walls 478 or other surfaces. In this embodiment, the shredders 474 are mounted to walls 478 of individual offices. Connectors 476, which may take the form of tubes or other structures that enable passage of articles or shredded articles therethrough, may be constructed and arranged to connect the shredders 474 to a secondary shredder system 475. The secondary shredder system 475 includes the shredder mechanism 416 and vacuum 430. The shredder mechanism 16 and the vacuum 430 may be an integrated into a single unit or may be connected together by connectors such as tubes. The shredder mechanism 416 includes at least one cutter module having the cutter element and filter. In some embodiments, the shredder mechanism 416 may be similarly constructed and may include similar components as any of the shredder mechanisms 16, 116, 216, 316 described above. The connector 476 is connected to the inlet port 415 of the shredder mechanism 416 to enable unshredded articles or shredded articles from the shredders 474 to enter into the shredder mechanism 16 where the cutter element of the module shreds the articles into shredded particles. The shredder mechanism 416 is connected to the vacuum 430 having an impeller that creates a suction force to suction in the articles from the shredders 474 and to force particles below a predetermined size to pass through the openings of the filter to the vacuum 430. In some embodiments, the vacuum 430 may include similar components and may be similarly constructed as the vacuums 30, 130, 230, 330 described above. The vacuum 430 then impels air and particles through the exit port 417 and through a connector 482 to the waste receptacle 411. In this embodiment, the waste receptacle 411 takes the form of an open faced bin.

This embodiment of the shredder system 472 enables higher security, smaller particles to be produced compared to the particles or articles produced from just the shredder 474. If higher security or smaller particles are needed, additional cutter modules may be added to the shredder mechanism 416. In some embodiments, waste bins or receptacles in the shredders 474 may be omitted, and the shredded articles or particles from the shredder 474 may be vacuumed to the secondary shredder system 475 for further shredding, after which the particles are then deposited into the shared waste receptacle 411. The secondary shredder system 475 may operate concurrently with the shredder 474 or may be selectively operated depending on user selection or predetermined timing. In embodiments where the secondary shredder system 475 periodically operates, the shredders 474 may include a waste receptacle that temporarily stores the shredded articles until the secondary shredder system 475 operates.

In some embodiments, the rotary blades 24, 124, 224, and 324 of the cutter element 20, 120, 220, and 320 may be constructed and arranged to create lift so as to prevent shredded particles having sizes larger than the openings of the filters 28, 128, 228, and 328 from being sucked against the filter and clogging the filter 28, 128, 228, and 328. Accordingly, the particles having sizes larger than the openings of the filter 28, 128, 228, and 328 may be further shredded until their sizes are smaller than the size of the openings of the filter, whereupon they may be sucked through the openings of the filter 28, 128, 228, and 328 by the vacuum 30, 130, 230, 330, 430. Thus, the rotary blades 24, 124, 224, 324 may agitate the shredded particles to prevent the clogging of the filters 28, 128, 228, and 328 by the particles. In some embodiments, the vacuum 30, 130, 230, 330, 430 may optionally be "pulsed" or turned on/off to unclog the filter 28, 128, 228, and 328. In some embodiments, the shredder mechanism may have two exhausts or exit ports and two vacuums, each vacuum being connected via tubing or other conduits to an exhaust or exit port. In such embodiments, the filter of each module may be divided into two portions, one associated with one of the exit ports and vacuum and the other associated with the other exit port and vacuum. Accordingly, the vacuum may reciprocate so as to prevent clogging of the filters. That is, if a filter is clogged, the other vacuum may provide enough suction to cause the particles to go towards the other filter, and thus moving the particles through the rotary blades for further shredding. The other cutter modules may be configured in a similar manner to prevent clogging of the filters.

Referring back to FIG. 1, the shredder 10 may operate as follows in accordance with an embodiment. A user may insert articles for shredding into the feed mechanism 14. An on/off switch may be engaged to turn on the shredder or an activation sensor may be activated by the insertion of articles. The controller may then send signals to the motors, for example the motor 32, and drive systems to operate the vacuum 30, the cutter elements 20, 20*a*, and the feed mechanism 14. In embodiments where the feed mechanism 14 includes the feed rollers 38 and arms 40 (as shown in FIG. 1), the articles may be received between the rollers 38 and advanced through to the rotary shredder mechanism 416 at a controlled, predetermined rate. In embodiments where the shredder 10 includes the tray 48 and the feed mechanism 14 (as shown in FIG. 3A) that includes the rotatable feed roller 56, the arm 58, and the feed driver system 60, the driver system 60 may drive the feed mechanism 14 in a feeding direction to feed paper on the stack 52 to the shredder mechanism 16. For example, the arm 58 may be moved in an alternating manner between the lowered and raised position such that the arm 58 alternates between engaging the stack 52 to feed paper and disengaging from the stack to allow the paper to be advanced therethrough to the shredder mechanism 16 at a controlled rate. In embodiments where the feed mechanism 14 includes a preliminary shredder mechanism 44 (as shown in FIG. 2A), the articles may be inserted into the throat 42 where they are received between the cutter elements 46 for shredding. The rotating cutter elements 46 may produce cross-cut or strip-cut shredding operations, and the shredded articles may then be suctioned into the rotary shredder mechanism 16 by the suction force created by the impeller 34 of the vacuum 30.

After the articles (which may either be shredded or unshredded depending on the embodiment of the feed mechanism 14) are fed into the shredder mechanism 16, the cutter element 20 may shred the articles into shredded particles in the cutting compartment 26. Particles smaller than the openings of the filter 28 may then be suctioned into the cutting compartment 26*a* of the second cutter module 18*a*. Particles that are larger may be continued to be shredded until they may fit through the openings of the filter 28 into the second module 18*a*. The cutter element 20*a* of the second module 18*a* may then continue to shred the particles until they are sufficiently sized to be able to fit through the openings of the filter 28*a* of the second module 18*a*. These particles are then suctioned into the vacuum 30. Vanes or other structures provided on the impeller 34 may further shred the particles, and additional filters may be provided to enable smaller particles to be filtered to the waste receptacle 11.

In accordance with an embodiment, the shredder 110 may operate in a similar manner as the shredder 10 with the feed mechanism 114 and the preliminary shredder mechanism 144. For example, the articles may be shred by the preliminary shredder mechanism 144. The shredded articles may then be suctioned into the shredder mechanism 116 by the suction force created by the impeller 134 of the vacuum 130. The cutter element 120 may then shred the articles in the cutting compartment 126. Particles having a predetermined size may be filtered through the filter 128 and into the vacuum 130, which may continue to shred the particles. The particles may then be forced out to a waste receptacle.

The shredder system 472 may operate as follows in accordance with an embodiment. The articles to be shredded may be inserted into the shredders 474. Each shredder 474 may include a primary shredder mechanism, which may be similar to, just for example, the preliminary shredder mechanism 44 described above. Activation sensors or an on/off switch may be actuated to power the shredder 474 such that the controller sends signals to the motors and drive systems to shred the articles.

After the shredder 474 has shredded the articles, the shredded articles may then be suctioned to the secondary shredder system 475 through the tubes 476 by the suction force produced by the impeller of the vacuum 430. The shredded articles may enter the shredder mechanism 416 through the inlet port 415. The cutter elements 420 may shred the articles into shredded particles and the particles below a predetermined size may be filtered to the vacuum 430. The shredding and filtering may be repeated depending on the number of cutter modules that are provided. The vacuum 430 may then shred the articles and then impel the articles and the air into the waste receptacle 411. Accordingly, the shredded articles/particles from the shredders 474 may be combined into the waste receptacle 411 for easier disposal.

While the principles of the invention have been made clear in the illustrative embodiments set forth above, it will be apparent to those skilled in the art that various modifications may be made to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A shredder for shredding articles, the shredder comprising:

a shredder mechanism comprising:

(a) a first cutter arrangement constructed and arranged provide a first stage of shredding to shred the articles; and (b) a second cutter arrangement constructed and arranged to provide a second stage of shredding to shred the articles received from the first cutter arrangement, the second cutter arrangement comprising:

a rotary cutter element constructed and arranged to be rotatable to shred the articles into shredded particles;

a filter having openings to enable the shredded particles below a predetermined size to pass therethrough;

an outlet constructed and arranged to allow shredded particles to exit therefrom; and a vacuum constructed and arranged to provide air flow for entraining and moving the articles and/or particles through the outlet, wherein the vacuum comprises a rotatable impeller constructed and arranged to provide air flow through at least the second cutter arrangement for entraining and moving the articles and/or particles through the second cutter arrangement and further into and through the vacuum itself, and wherein the rotatable impeller of the vacuum is configured to further shred the articles and/or particles before impelling the articles and/or particles out through the outlet.

2. The shredder of claim 1, wherein the first cutter arrangement is part of a strip cut shredder mechanism comprising strip cutting blades that cut the articles via a shearing action.

3. The shredder of claim 1, wherein the first cutter arrangement is part of a cross cut shredder mechanism comprising interleaving cutter elements provided on rotatable, parallel shafts that are arranged to receive and shred articles therebetween.

4. The shredder of claim 3, further comprising a final cutter arrangement having a rotary cutter element constructed and arranged to be rotatable to shred the articles into shredded particles.

5. The shredder of claim 1, wherein the first cutter arrangement comprises a rotary cutter element constructed and arranged to rotate around a first axis, and wherein the rotary cutter element of the second cutter arrangement is constructed and arranged to rotate around a second axis.

6. The shredder of claim 5, wherein the first and second axis are the same.

7. The shredder of claim 1, wherein the first cutter arrangement comprises:

a first rotary cutter element constructed and arranged to be rotatable to shred the articles into shredded particles; and a first filter having openings to enable the shredded particles below a predetermined size to pass therethrough.

8. The shredder of claim 1, further comprising a feed mechanism, and wherein the feed mechanism is controlled to feed the articles to the shredder mechanism at a predetermined rate.

9. The shredder of claim 8, wherein the feed mechanism comprises rotatable feed rollers for receiving the articles therebetween to advance the articles to the shredder mechanism.

10. The shredder of claim 1, wherein the first cutter arrangement is remote from the second cutter arrangement and the vacuum.

11. The shredder of claim 1, wherein the vacuum is part of the second cutter arrangement.

12. The shredder of claim 1, further comprising:

a tray for holding a stack of paper sheets to be fed into the shredder mechanism; and a feed mechanism constructed and arranged to be movable between an engaged position for engaging the stack and a disengaged position for disengaging from the stack so as to drive and feed the paper into the shredder mechanism.

13. The shredder of claim 1, further comprising:

a tray for holding a stack of paper sheets to be fed into the shredder mechanism;

a feed mechanism positioned above the tray, and wherein the feed mechanism is movable between a lowered position for engaging the stack and a raised position for disengaging from the stack, and a feed driver system constructed to (a) drive the feed mechanism in a feeding direction to feed paper atop the stack to the shredder mechanism, and (b) move the feed mechanism in an alternating manner between the lowered and raised position such that the feed mechanism alternates between engaging the stack to feed paper and disengaging from the stack to allow the paper to be advanced therethrough.

14. The shredder of claim 1, wherein the first cutter arrangement comprises at least two rotary cutter elements disposed in an interleaving relationship for shredding the articles fed therein, and wherein the second cutter arrangement receives the shredded articles from the first cutter arrangement for further shredding.

15. The shredder of claim 1, wherein the second cutter arrangement comprises a cutter compartment comprising a textured inner surface to decrease a speed of the articles passing through the cutter compartment.

16. The shredder of claim 1, wherein the second cutter arrangement and the vacuum are removable from the shredder.

17. The shredder of claim 16, wherein the vacuum is part of the second cutter arrangement.

18. The shredder of claim 1, further comprising a final cutter arrangement, and wherein the vacuum is part of the final cutter arrangement.

19. The shredder of claim 1, further comprising a waste receptacle having an interior waste receiving space for receiving the shredded particles from the rotary shredder mechanism.

20. The shredder of claim 19, wherein the waste receptacle is remote from the feed mechanism.

21. The shredder of claim 19, wherein the waste receptacle is removable from the shredder.

22. The shredder of claim 1, wherein the vacuum is constructed and arranged to generate a negative pressure adjacent the shredder mechanism to entrain and move the articles and/or particles through the outlet.

23. A shredder system comprising:

at least one shredder having a primary shredder mechanism constructed and arranged to shred articles fed therein;

a secondary shredder mechanism remote from the at least one shredder and constructed and arranged to receive the shredded articles from the at least one shredder, the secondary shredder mechanism comprising a first cutter module including a first rotary cutter element constructed and arranged to be rotatable to further shred the shredded articles into smaller particles and a first filter having openings to enable the shredded particles below a predetermined size to pass therethrough;

a vacuum constructed and arranged to provide air flow for entraining and moving the shredded articles and/or particles from the at least one shredder through the secondary shredder mechanism and to suction the articles and/or particles into the vacuum itself, the vacuum comprising a centrifugal fan having a rotatable impeller, and a waste receptacle having an interior waste receiving space for receiving the shredded particles from the secondary shredder mechanism, wherein the rotatable impeller of the vacuum is configured to further shred the articles and/or particles before impelling the articles and/or particles out for receipt in the waste receptacle.

24. The shredder of claim 23, wherein the first cutter module comprises a textured inner surface to decrease a speed of the articles passing through the first cutter module.

25. The shredder of claim 23, wherein the waste bin comprises a filter for exhausting air from the vacuum therethrough.

26. The shredder of claim 23, wherein the secondary shredder mechanism comprises a second cutter module including a second rotary cutter element and a second filter, and wherein the first cutter module is connectable to the second cutter module such that the shredded particles from the first cutter module are further shredded into smaller particles by the second rotary cutter element.

27. The shredder of claim 23, wherein the secondary shredder mechanism comprises a second cutter module, and wherein the vacuum is part of the second cutter module.

28. The shredder of claim 23, wherein the secondary shredder mechanism comprises a final cutter module, and wherein the vacuum is part of the final cutter module.

29. The shredder of claim 23, wherein the first cutter module comprises another filter connected to the first filter to decrease the predetermined size of the particles that are allowed to pass therethrough.

30. The shredder of claim 23, further comprising a connection structure connecting the at least one shredder and the secondary shredder mechanism, and wherein the secondary shredder mechanism is constructed and arranged to receive the shredded articles from the at least one shredder via the connection structure.

* * * * *